United States Patent [19]

Warheit

[11] Patent Number: 4,662,252

[45] Date of Patent: May 5, 1987

[54] AUTO-GRIP PLIERS

[76] Inventor: William A. Warheit, 121 Iroquois Dr., Butler, Pa. 16001

[21] Appl. No.: 777,358

[22] Filed: Sep. 18, 1985

[51] Int. Cl.[4] ..... B25B 7/04

[52] U.S. Cl. ..... 81/341; 81/408; 81/411; 81/385

[58] Field of Search ..... 81/300–361, 81/362–379, 407, 408, 411, 385, 427

[56] References Cited

U.S. PATENT DOCUMENTS 2,714,198 7/1955 Schloetzer ..... 81/379
3,793,914 2/1974 Helms ..... 81/378

FOREIGN PATENT DOCUMENTS 2031661 1/1971 Fed. Rep. of Germany ..... 81/341

*Primary Examiner*—Frederick R. Schmidt
*Assistant Examiner*—Maurina Rachuba
*Attorney, Agent, or Firm*—George C. Atwell

[57] ABSTRACT

Utility pliers for single-handed manipulation, capable of automatically adjusting the distance between gripping jaws in relation to the size of the workpiece to be gripped, and utilizing one or more hidden springs to cause the automatic adjustment function. Alternative embodiments enable reduction of manufacturing costs, improved location of certain operative components, and the selective inclusion of additional features which enhance the use and operation.

14 Claims, 6 Drawing Figures

AUTO-GRIP PLIERS

BACKGROUND OF THE INVENTION

This invention pertains generally to utility pliers of the type generally referred to as water pump pliers or slip-joint pliers, and more particularly pertains to utility pliers of the slip-joint type which are adapted to automatically self-adjust to the size of any work piece within the range of the jaws of the pliers by a one-hand operation.

The prior art has provided a number of different types of slip-joint pliers. Such pliers have the common characteristic of jaws offset at an angle to the plier handles and a pivot post, in the form of a bolt or rivet, mounted in the area rearward of the jaw on one of the handles and projecting through an elongated slot on the other handle. In such pliers, means for enabling selective spacing of the distance between the jaws is variously provided by spaced-apart ridges or teeth along the inside long edge of the slot adapted for selective binding engagement with the pivot post. Another well-known method of providing distance adjustment between the jaws in such pliers is the provision of spaced-apart arcuate ridges on the interfacing surfaces adjacent the pivot point. All such tools, to be adjusted to the size of a particular work piece to be gripped between the jaws, require a two-handed operation wherein the handles are pulled wide apart to permit a sliding action of the pivot post along the slot to move the jaws to the desired work piece size.

Self-adjusting utility pliers are disclosed in pending U.S. patent application Ser. No. 654,405 filed Sept. 26, 1984, now U.S. Pat. No. 4,651,598; issued Mar. 24, 1987. The tool therein disclosed is intended for the same use and purpose as the aforedescribed prior art pliers but has the clear advantage of single-handed adjustment. Further, the pliers are adapted to slideably close upon a work piece in response to manual closing action on the handles, and, in response to contact with the work piece, automatically lock against further sliding action and shift from the sliding to a pivoting mode whereby continued exertion of manual force on the handles causes increased gripping action on the work piece.

The typical prior art slip-joint pliers which require two-handed adjustment, as heretofore described, are usually massproduced by a drop forging operation, the handle members are solid metal, and the area of connection between the two handle members is relatively planar and thin, whereas the gripping jaws are laterally inwardly widened to provide gripping surfaces which overlap into the plane of the center point of the axis of the pliers' interconnecting pivot. The aforementioned self-adjusting utility pliers also are most easily adaptable to a substantially solid handle member construction obtainable through a forging operation.

SUMMARY OF THE INVENTION

The present invention related to utility pliers having the capability of automatic self-adjustment, and more particularly pertains to alternative improved constructions for such pliers.

More specifically, in pliers of the type having a pair of pivotally connected first and second handle members with opposed gripping jaws and slot means in the first handle member enabling it to be slid relative to a pivot element projecting into the slot from the second handle member to vary the distance between the jaws, and wherein such pliers include biasing means operatively connecting the handle members and adapted to normally urge the handle the handle members to slide relative to each other whereby the jaws are disposed to their widest open position, improved alternative structures are provided wherein the biasing means includes a linking arm and at least one spring totally contained within the first handle member.

The linking arm interconnects the handle members at their neck portions or a position generally intermediate the distance between the extreme outer ends or distal ends of the handle members and the pivot element which joins the handle members. The linking arm has its first end pivotally secured to the second handle member and its second end pivotably and slideably secured to the first handle member. The second end of the linking arm is adapted to slide longitudinally a distance along a predetermined path which constitutes an inwardly facing linear slot in the first handle member. The spring disposed within the first handle member interconnects the second end of the linking arm with a point in the throat area of the second handle member which is closely adjacent the pivot element.

A fixed stop is provided on the first handle member and marks the end of the predetermined path which is further from the distal end of the handle member and toward the pivot element. The linking arm is adapted to pivot relative to the stop and respond to the pulling force of the spring so that the linking arm translates such pulling force to the second handle member as a force generally in a direction toward the distal end of the second handle member whereby the jaws are caused to normally slide to a fully open position.

The improved pliers in accordance with both alternative structures or embodiments herein disclosed, include a throat area or portion on the first handle member constituting rigid spacedapart and parallel sections. Each such section is provided with an elongated slot, and the throat area of the second handle member is disposed between the sections whereby the pivot element interconnecting the handle members projects laterally on opposite sides of the second handle member and extends through the slot in each section.

The pivot element is adapted to engage, along portions of the first handle member defining respective long edges of the slots, in response to a work piece disposed between the jaws and manual force being exerted against the handle members to move the jaws against the work piece. The preferred means of engaging the pivot element with the long edges of the slots is the provision of successive teeth along the slot edge into which a rotatable pawl can interlock by engagement with adjacent pairs of teeth. A separate pawl is operatively associated with each longitudinal slot, and each pawl is designed to track and cam within the slot during use of the pliers as will be hereafter described in greater detail.

In both the presently preferred embodiments herein disclosed, a unique pivot element is utilized constituting a disc-shaped member having a integral pawl formed on each of its opposite faces, and the element is carried for rotation within a circular opening provided in the throat area of the second handle member.

Another feature of both of the preferred embodiments disclosed herein is the provision of manually operable means for releasably locking the handle members, and hence their jaws, in a fully closed or predetermined open disposition.

Other features and characteristics in accordance with the present invention, which are either adaptable to both the presently preferred embodiments herein disclosed or preferably included on only one of them, will be understood and appreciated from the ensuing detailed description of the various figures of the drawings.

DETAILED DESCREPTION OF THE PREFERRED EMBODIMENTS

Figure 1:
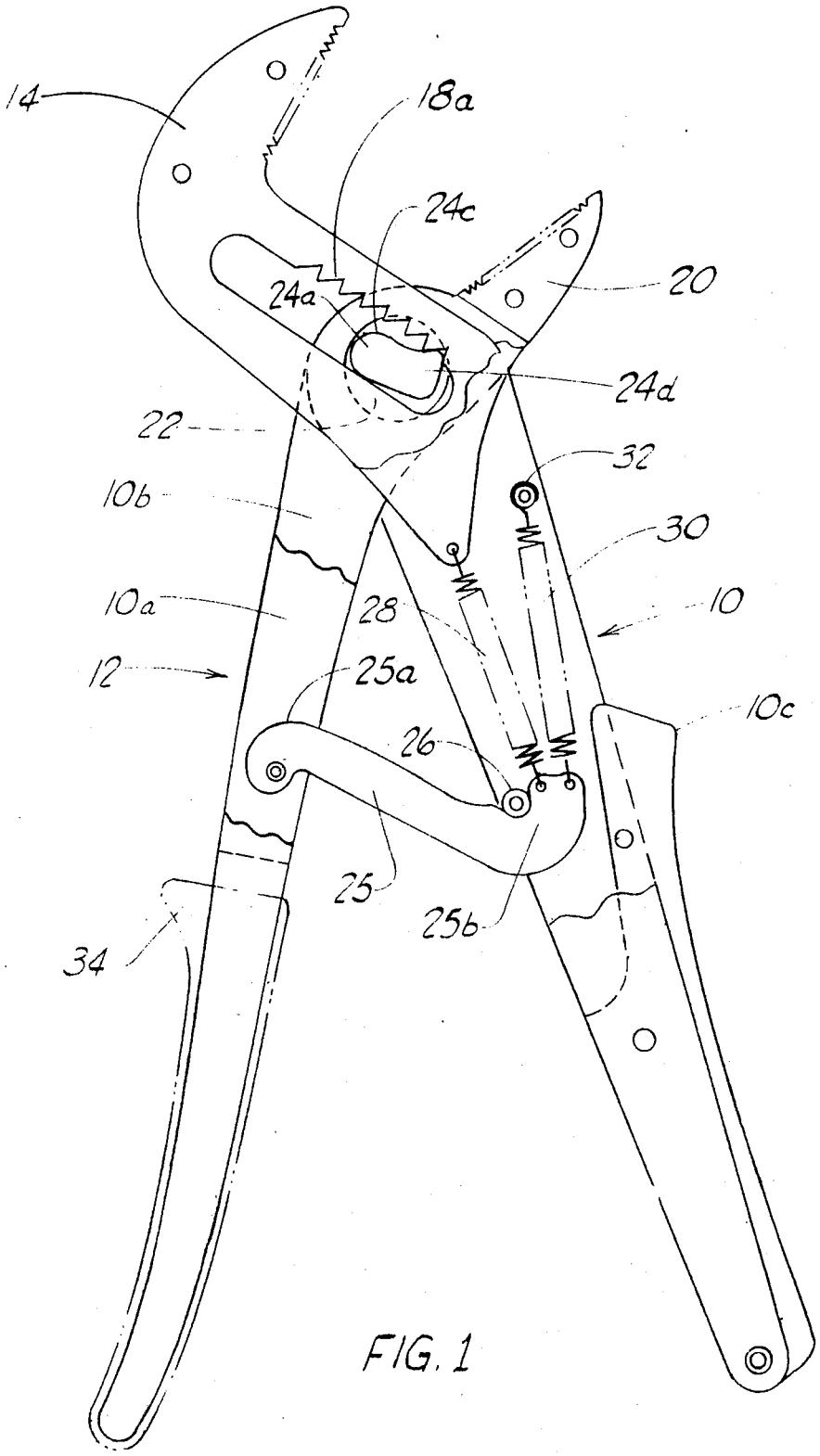
FIG. 1 is a side elevational view of a first presently preferred embodiment of the improved auto-grip pliers in accordance with the present invention.
Figure 2:
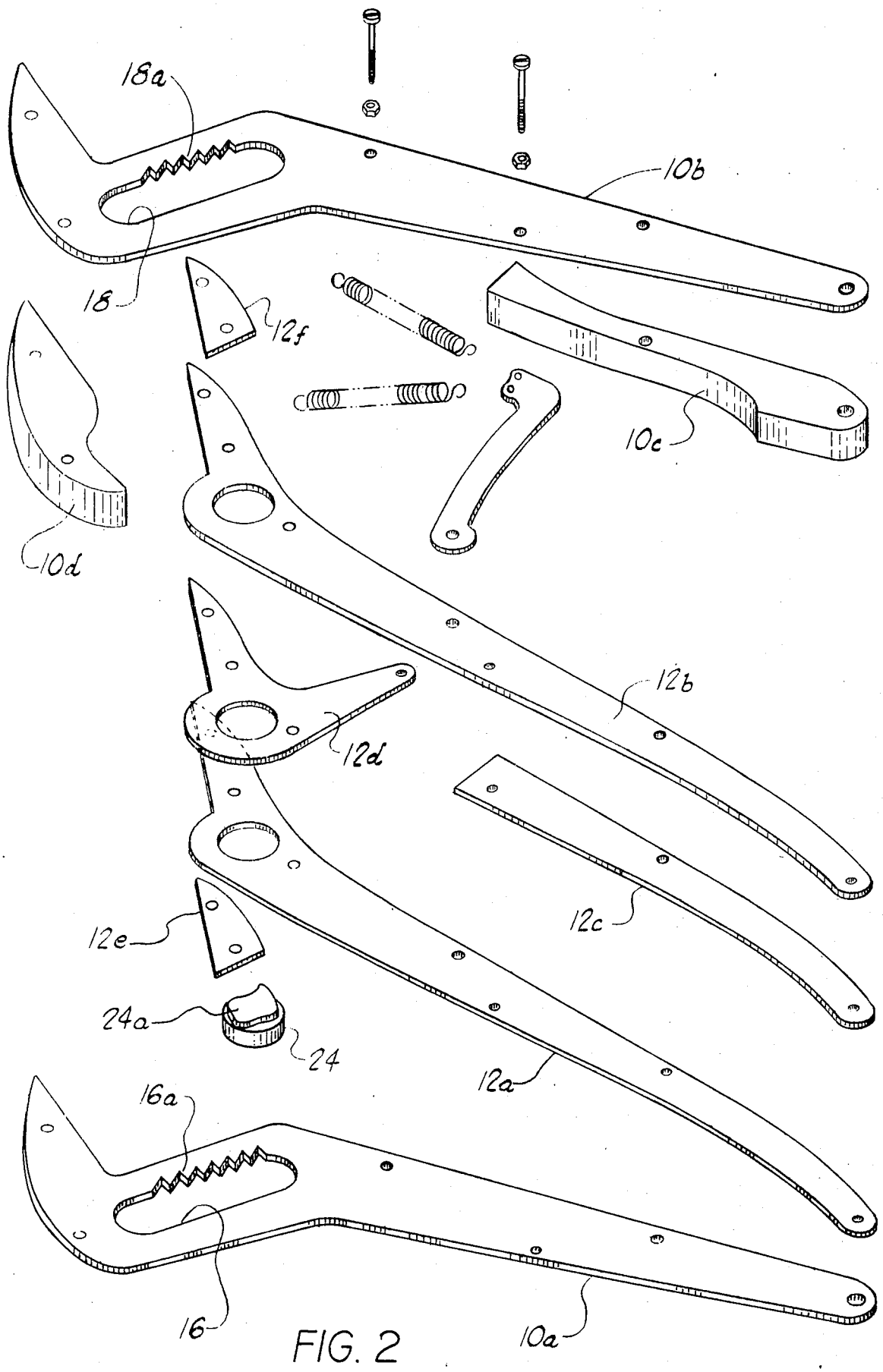
FIG. 2 is an exploded or perspective assembly layout of the constituent parts of the embodiment first shown in FIG. 1.

In FIG. 1 there is shown one presently preferred embodiment of pliers in accordance with the present invention. The pliers shown in FIG. 1 comprise a first handle member 10 which coacts with a second handle member 12, as will be hereafter described. The handle member 10 is made substantially from flat sheet steel parts laminated together to form a rigid whole. FIG. 2 shows that the handle member 10 is comprised of rigid planar members 10*a* and 10*b* which are assembled with spacers 10*c* and 10*d* therebetween. The spacer 10*c* may be formed from any suitable rigid lightweight plastic material, with an outer surface as shown in FIG. 1, to present a hand gripping surface in the use of the tool. Spacer 10*d* is cut from metal bar stock and serves as an inside laminate between the parts 10*a* and 10*b* to form the jaw end 14 of the handle member 10 as shown in FIG. 1. Each of the parts 10*a* and 10*b* are provided with identical elongated slots 16 and 18 having, along one long edge thereof, respective toothed racks 16*a* and 18*a*, each made up of a series of successive identical sized teeth providing spaces therebetween.

The second handle member 12 is similarly constructed from laminated flat parts, as shown in FIG. 2, which includes elongated planar parts 12*a* and 12*b*, a separator 12*c*, a jaw end separator 12*d*, and outside jaw portions 12*e* and 12*f*. All of the foregoing parts are suitably pinned to form the rigid second handle member 12. The jaw end 20 of handle member 12, as shown in FIG. 1, is formed when the parts 12*a* and 12*b* (FIG. 2) are united with the separating parts 12*c* and 12*d* properly aligned therebetween, and the wedged shaped parts 12*e* and 12*f* are fastened, in the same joining operation, to the respective outside jaw end surfaces of the parts 12*a* and 12*b*.

The second handle member 12, in its throat portion, which is rearward of the jaw 20, is pivotably and slideably secured between the parts 10*a* and 10*b* of the first handle member 10 whereby the slot 16 is on one side of the throat portion of the handle member 12 and the slot 18 is on the other side of the throat portion. A circular opening 22, as shown in FIG. 1, is provided through the throat area of the second handle member 12, and contained within the opening is a disc-shaped element 24 (see FIG. 2) having an integral pawl 24*a* on the face thereof which is visible on both FIGS. 1 and 2. An identical pawl (not shown) is provided on the opposite face of the element 24 whereby the element 24 has oppositely facing identical pawls for operative interaction with the respective toothed racks 16*a* and 18*a*.

FIGS. 1 illustrates that the handle members 10 and 12 are interconnected by a crossover linking arm 25. The linking arm 25 is a rigid planar part having a first end 25*a* hidden from sight by disposition between parts 12*a* and 12*b*. The linking arm 25 has a second end 25*b* disposed between parts 10*a* and 10*b* of handle 10. The end 25*b* normally rides against a stop 26 in view of the pulling force of a spring 28 which interconnects the end 25*b* and a triangular extension of part 12*d* which is the center laminate of handle member 12. A second spring member 30 interconnects the end 25*b* with a stationary pin 32 on the handle member 10, for a purpose hereafter described.

Also shown in FIG. 1, on handle member 12, is a flexible plastic sleeve 34 which can be designed to blend in color and shape with the plastic laminate 10*c* to create a comfortable hand hold for the user of the pliers.

Figures 3, 4:
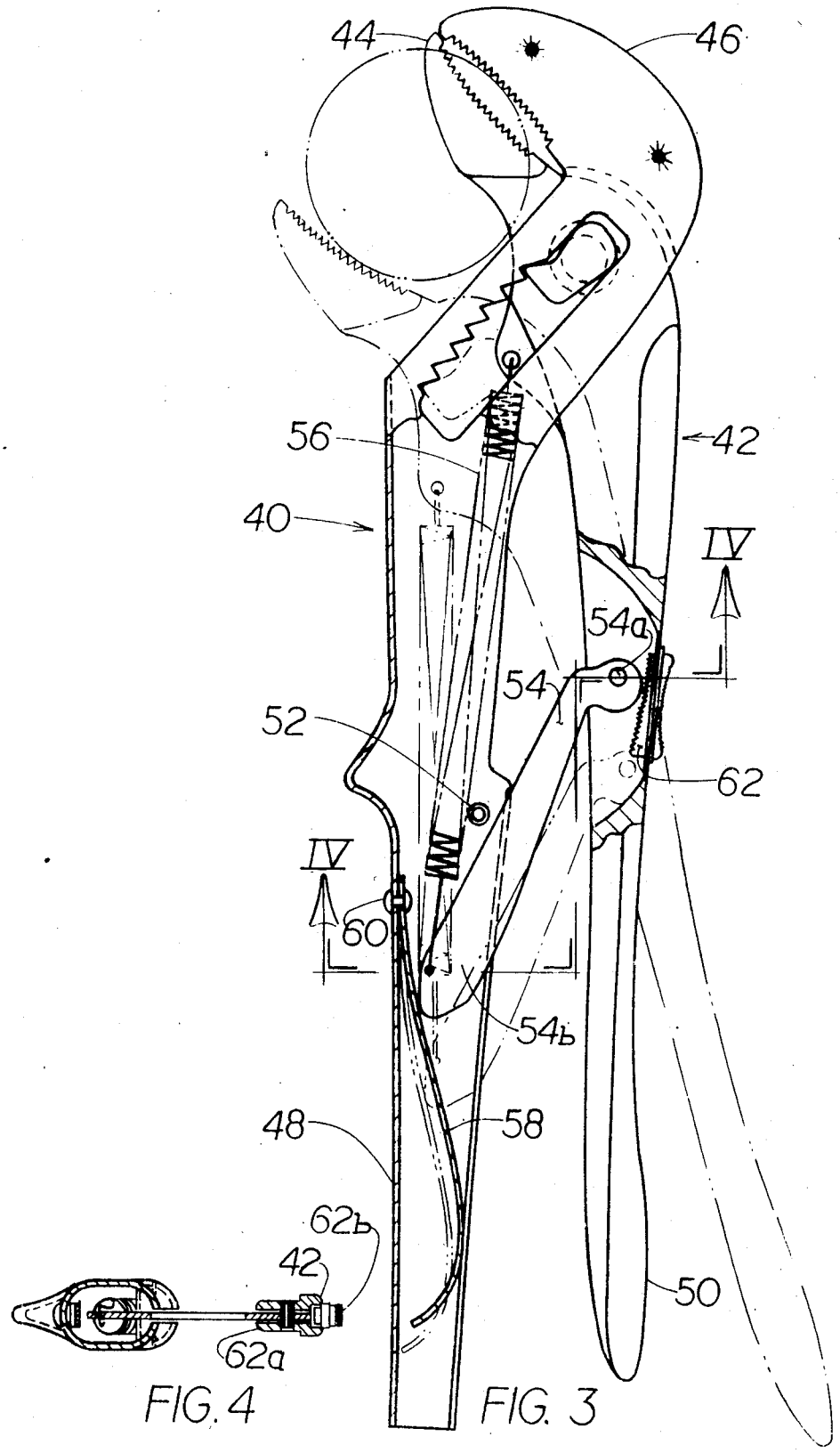
FIG. 3 is a side elevational view of an alternate or second presently preferred embodiment of improved auto-grip pliers in accordance with the present invention.
FIG. 4 is a sectional view taken along lines IV—IV of FIG. 3.

FIG. 3 illustrates an alternate or second presently preferred embodiment of the disclosed invention, showing pliers disposed in a fully closed position and further, illustrating in phantom outline, the disposition of one of the handle members and certain related components of the pliers when a large item such as a piece of pipe is grasped between the jaws.

Specifically, the pliers in FIG. 3 comprise a first handle member 40 and a second handle member 42. The pivotal connection between the handle members is substantially the same as disclosed herein with reference to the embodiment shown in FIG. 1, utilizing the disc-shaped pivot element 24 as shown in FIG. 2. The respective handle members 40 and 42 have opposed gripping jaws 44 and 46, and handle ends 48 and 50. A slot means is provided in the first handle member 40 and comprises spaced apart identical elongated slots between which extends the throat area of the second handle member 42.

Figures 5, 6:
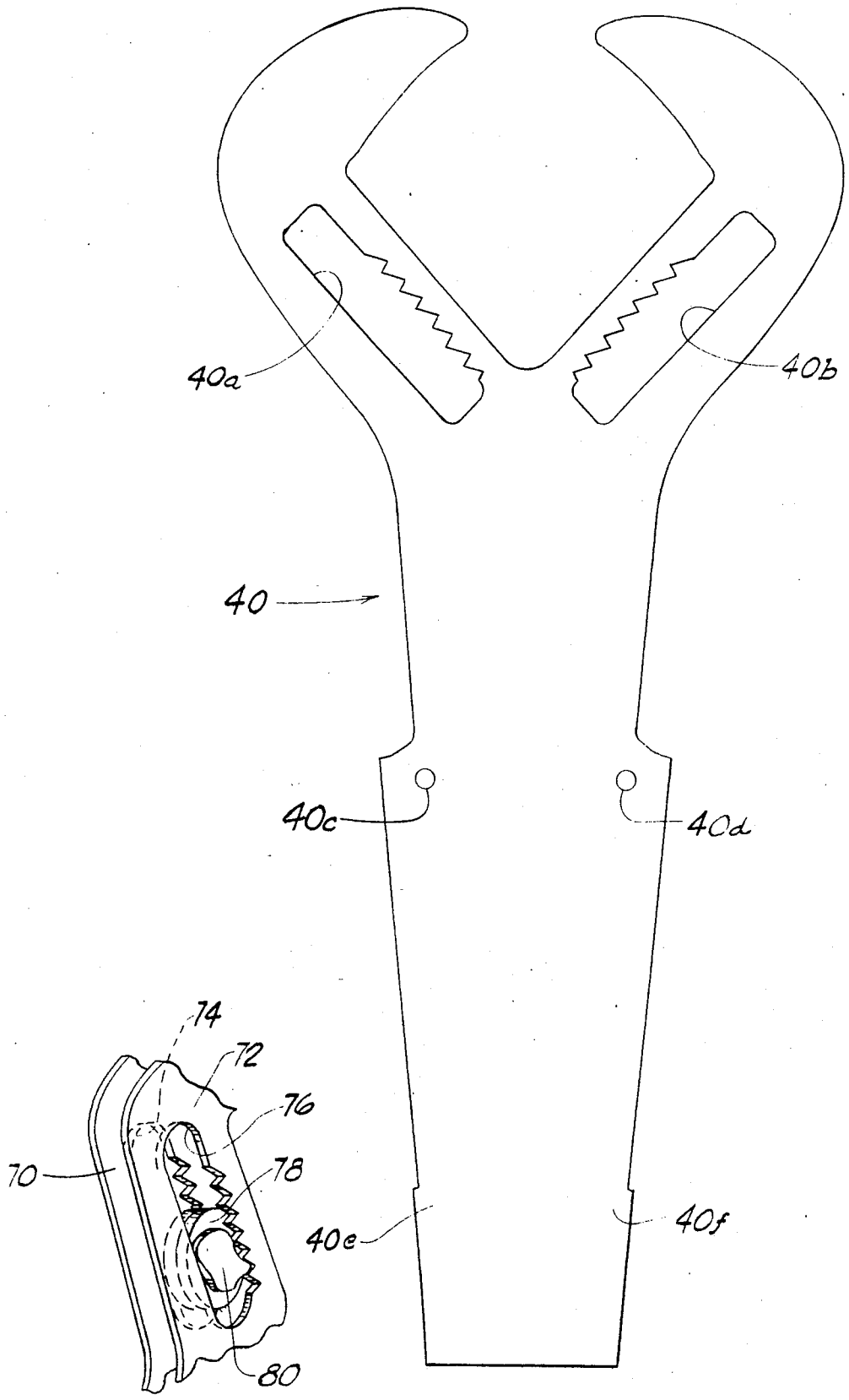
FIG. 5 is a pattern layout illustrating how one or more of the handle members of an alternate embodiment of the invention may be stamped from a flat metal sheet for forming thereafter to the configuration of a handle.
FIG. 6 is a frangmentary isometric view of an alternative tooth and pawl arrangement usable in either embodiment of the invention herein disclosed.

FIG. 5 illustrates handle 40 as it appears prior to being formed to the shape shown in FIG. 3. The handle 40 is stamped, in the pattern configuration shown in FIG. 5, from a relatively thin metal sheet in which slots 40*a* and 40*b* are provided. Aperture 40*c* and 40*d* are provided to accommodate, after formation of the blank into the configuration shown in FIG. 3, a stationary pin 52 which serves as a stop for a purpose hereinafter described. FIG. 5 also shows, at the handle end of the blank, edge portions 40*e* and 40*f* which will abut when the pressing operation is completed to turn the blank into the shape shown in FIG. 3, whereby the long outer edges of the pattern shown in FIG. 5 above the area of the portions 40*e* and 40*f* will be spaced a short distance apart to form a slot or sliding path, as shown in FIG. 3, for a linking arm 54.

As shown in FIG. 3, the linking arm 54 has a first end 54*a* pivotably connected within a longitudinal inwardly facing slot in the handle member 42. A second end 54*b* of the linking arm 54 is disposed within the handle member 40 and is connected by a coil tension spring 56 to the underside of the throat area of handle member 42. The end 54*b* of the linking arm 54 is adapted to slide, during operation of the pliers, in a predetermined pathway which extends from the stop 52 toward the handle end 48 of the handle member 40. Carried within the handle member is a leaf spring 58 fastened at one end to the handle by a rivet 60. The leaf spring 58 is temporarily deformable by downward sliding action of the end 54*b* of the link 54 whereby a slight upward pressure is constantly applied against the end 54*b*.

Shown on the handle member 42 and also in FIG. 4 is a releasable locking means to enable the user of the pliers to selectively temporarily lock the handles, and hence the jaws of the pliers, in a fully closed or partially closed position. The releasable locking means, denoted by the number 62 is located coincidental with a short longitudinally extending slot on the back side of the handle 42 and includes an inside wedge portion 62*a* which is connected, by pins through the slot, to an outside button portion 62*b*. The button 62*b* is adapted for thumb operation whereby the user of the tool can slide it toward the jaw end thereof and cause the wedge portion 62*a* to move into contact with the end 54*a* of the linking arm 54 and exert a binding pressure thereagainst to lock the linking arm against pivoting action until the button 62*b* is actuated to move the wedge 62*a* away from contact with the linking arm and 54*a*.

The operation of the two embodiments of the pliers shown in FIGS. 1 and 3 is substantially identical, so description herein of the function is primarily with respect to the embodiment shown in FIG. 1, however, slight differences in the function of the pliers shown in FIG. 3 as compared to the embodiment of FIG. 1, will be hereafter specifically explained.

With reference to the FIG. 1 embodiment, it should be noted that the normal disposition of the pliers, ready for use, is a full open jaw disposition. Manipulation of the pliers to grip a work piece is accomplished by the user holding the pliers in one hand and closing the thumb and fingers about the handle ends 10 and 12. The pliers are positioned whereby the jaw ends 14 and 20 have the selected work piece therebetween, and squeezing of the user's hand causes the handle members to move inwardly whereby jaw 20 is caused to move toward jaw 14 until the work piece is contacted therebetween. This action causes a slight pivoting motion of the handle 12 on the pivot element 24, counter-clockwise as viewed in FIG. 1, whereby the pawl 24*a* is cammed within the slot so its tooth portion 24*d* engages between a pair of the adjacent teeth in a position consistent with the size of the work piece being gripped. Continued manual pressure on the handle members 10 and 12 causes the linking arm and 24*b* to slide downwardly relative to the handle 10 as viewed in FIG. 1 and pull away from the stop 26, stretching the springs 28 and 30. The movement of the linking arm 25 about the pivot pin which fastens its end 25*a* to the arm 12, causes the arm 25 to assume an acute angle relative to the distal end of the handle member 12 whereby the pulling force of the spring 30 at the end 25*b* of the linking arm 25 is translated generally linearly through the arm 25 to the handle member 12 to cause the pawl 24*a* to bind tightly with the teeth of handle member 10 whereby the usual user's manual pressure against the handle members is translated as a squeezing force through the jaws and against the work piece.

The general principles of operation of the pliers to accomplish the self-adjusting feature is more fully explained in co-pending U.S. patent application Ser. No. 654,405 filed Sept. 26, 1984, now U.S. Pat. No. 4,651,598; issued Mar. 24, 1987.

The operation of the embodiment of the pliers as shown in FIG. 3 is substantially as heretofore described, except that the second coiled tension spring 30 shown in FIG. 1 is eliminated and, in this embodiment, a deformable leaf spring 58 is provided in the space in the distal end of the handle member 40 to provide resistance against the end 54*b* of the linking arm 54 and thereby exert a pushing force linearly through the linking arm 54 to the pivot point 54*a* on the handle member 42.

With respect to either of the embodiments of pliers disclosed herein, a special arrangement may be made with respect to the pivot element and the spaced-apart toothed slots to thereby provide double the number of available stop positions, that is, the number of successive positions at which the pawl can interact with the toothed racks. FIG. 6 illustrates this feature, wherein throat area handle sections 70 and 72 are shown in spaced-apart disposition. The section 70 is provided with a slot 74 and the section 72 is provided with a slot 76. While the slots 74 and 76 are in alignment, the rack of teeth in one slot is offset relative to the rack of teeth in the other slot, one-half the distance taken across the base of a tooth. Hence, any given tooth in one slot is offset vertically from its counterpart tooth in the other slot. A pivot element 78, which would be disposed in an accommodating opening in the throat area of the other handle member of the tool, as heretofore described, is split into two identical disc-shaped members, each having an integral pawl 80 formed on the outer face thereof. This two-part pivot element permits the oppositely-facing pawls to move independently of each other and interact with the respectively adjacent teeth during operation of the pliers. Because of the off-set teeth arrangement, one pawl can engage between adjacent teeth, consistent with the size of the work piece being gripped, and the other pawl will then be out of proper alignment for engagement. The diameter or width of the work piece will determine which of the two pawls will engage and lock with its adjacent toothed rack and establish the position of the jaws for continued exertion of gripping action against the work piece.

The present invention has been described in connection with two embodiments of an auto-grip pliers construction, one of which enables inexpensive laminated construction, while the other enables forming and shaping of the major handle members from flat sheet metal stock, both considered relatively inexpensive as compared to the high start-up costs associated with a forging operation which is more typical in slip-joint pliers of the prior art.

Although the presently-preferred embodiments has been described with some particularity, it is to be understood that other embodiments or variations may be made without departing from the spirit and scope of the invention, as those skilled in the art will readily understand. Such embodiments and variations are considered to be within the purview and scope of the invention and the appended claims.

I claim:

1. Pliers having first and second rigid elongated handle members; each having a jaw end, a handle end, and an intermediate neck portion; slideable and pivotable fastening means connecting the members between their neck portions and permitting the jaw ends to move toward each other in a sliding action in response to an initial manual closing force being applied to close the handle ends toward each other to grasp a workpiece between the jaw ends; the fastening means acting to halt further sliding action of the members in response to the jaw ends contacting the workpiece and to then translate increase of the closing force on the handle members as a pivoting gripping action of the jaw ends on the workpiece;

biasing means, coacting between the members and normally urging the jaw ends to slide away from each other to a fully opened disposition, including a linking arm and a spring;

the linking arm interconnecting the handle members and located between the throat portions and the distal ends of the handle members, a first end of the linking arm pivotally secured to the second handle member, the linking arm normally resting against a fixed stop on the first handle member and normally held thereagainst by the spring, the spring interconnecting a point on the second handle member throat portion and a point on the second end of the linking arm outward from the fixed stop, the spring normally acting to urge the linking arm to pivot in a first direction on the second handle member and about the fixed stop to exert a pulling force on the second handle member and cause it to slide its jaw end away from the jaw end of the first handle member, and, in response to a workpiece being gripped between the jaw ends, permitting the linking arm to pivot in a direction on the second handle member opposite to the first direction so that the linking arm moves away from the fixed stop and generally toward the distal end of the first handle member.

2. The pliers of claim 1 wherein the spring is disposed within the first handle member.

3. The pliers of claim 1 wherein the first handle member includes a throat portion having rigid spaced-apart and parallel sections, an elongated slot in each section constitutes the slot means, the second handle member extends through the space between the sections, and the pivot element projects laterally on opposite sides of the second handle member and extends through the slot in each section.

4. The pliers of claim 1 wherein the pivot element is adapted to engage, along portions of the first handle member defining respective long edges of the slots, in reponse to a work piece disposed between the jaws and manual force being exerted against the handle members to move the jaws against the work piece.

5. The pliers of claim 4 further comprising means normally urging the pivot element out of engagement with the respective longitudinal slot edges.

6. The pliers of claim 1 wherein the handle members are constructed to have outer sidewalls defining respective interior spaces in the handle members, and the respective ends of the linking arm are disposed within the respective interior spaces of the handle members.

7. The pliers of claim 1 further comprising a second spring acting to normally urge the second end of the linking arm toward the stop.

8. The pliers of claim 7 wherein the second spring is contained within the first handle member.

9. The pliers of claim 1 wherein the first handle member has spaced-apart throat sections, the slot means comprises an elongated slot in each of said sections, and a pivot element extends across the space between the slots.

10. The pliers of claim 9 wherein the pivot element is disc-shaped and is carried in a circular opening in the second handle member.

11. The pliers of claim 9 wherein each of the slots has a long edge with successive teeth therealong, and the pivot element includes a pair of pawls, each disposed to project in the plane of, and slide relative to, one of the slots, and each adapted to engage between adjacent ones of the teeth during use of the pliers.

12. The pliers of claim 11 wherein the teeth of one of the slots are offset relative to the teeth of the other slot, and the pawls are adapted to operate independent of each other whereby one of the pawls engage between adjacent teeth when the other pawl is out of such engagement.

13. The pliers of claim 1 further including releasable locking means for securing the jaws in a predetermined disposition comprising a button operatively mounted on the second handle member and having means for selectively engaging and arresting the the pivotal action of the linking arm such that the sliding action of the handle members toward their widest opened position is curtailed.

14. The pliers of claim 13 wherein the locking means is disposed at least partially on the outside of the first handle member and comprises a button for rapid actuation by the thumb of the user of the pliers.

* * * * *